United States Patent [19]

Michaels et al.

[11] Patent Number: 4,665,848

[45] Date of Patent: May 19, 1987

[54] METHOD AND APPARATUS FOR AUTOMATICALLY HEMMING GARMENTS

[75] Inventors: Sid Michaels, Garland; Pedro T. Silva, Dallas, both of Tex.

[73] Assignee: Levi Strauss & Co., Richardson, Tex.

[21] Appl. No.: 579,696

[22] Filed: Feb. 13, 1984

[51] Int. Cl.[4] ..... D05B 21/00; D05B 35/02

[52] U.S. Cl. ..... 112/121.26; 112/147

[58] Field of Search ..... 112/121.26, 121.27, 112/64, 67, 81, 120, 121.11, 121.18, 305, 306, 272, 277, 254, 220, 303, 117, 147, 141, 121.13, 2, 318, 322

[56] References Cited

U.S. PATENT DOCUMENTS

| | | | |
|---|---|---|---|
| 4,098,204 | 7/1978 | Kujima | 112/147 |
| 4,171,575 | 10/1979 | Blessing et al. | 112/121.26 |
| 4,381,719 | 5/1983 | Goldbeck | 112/272 |
| 4,455,956 | 6/1984 | Yamamoto et al. | 112/67 |
| 4,473,017 | 9/1984 | Letard et al. | 112/121.26 |
| 4,479,447 | 10/1984 | Rohr | 112/147 |
| 4,555,999 | 12/1985 | Conner | 112/121.27 |

FOREIGN PATENT DOCUMENTS

| | | | |
|---|---|---|---|
| 0044648 | 1/1982 | European Pat. Off. | 112/272 |

*Primary Examiner*—Werner H. Schroeder
*Assistant Examiner*—Joseph S. Machuga
*Attorney, Agent, or Firm*—Limbach, Limbach & Sutton

[57] ABSTRACT

An apparatus is disclosed for automatically forming and hemming garments which are circular or tubular in shape, comprising an expandable multi-roller and cam assembly for mounting and tensioning the garment about the assembly, and which further comprises a means for selectively engaging or disengaging one of the rollers of the assembly depending on the size and shape of the garment to be hemmed. The apparatus further comprises means for loading the circular garment from the multi-roller expandable assembly into a folding device which is used to fold a hem of a predetermined depth into the garment prior to the hem being sewn.

4 Claims, 16 Drawing Figures

METHOD AND APPARATUS FOR AUTOMATICALLY HEMMING GARMENTS

DESCRIPTION

1. Technical Field of Invention

This invention relates to an apparatus and method for automatically folding and stitching the hem in tubular-shaped garments.

2. Background Art

Tubular shaped garment parts are commonly finished with a hem in which the raw edge of the fabric is folded over either in a single fold or double fold and a circumferencial stitch is sewn through the fold to form the hem. In tailoring pants, particularly jean type styles, the bottom hem may vary in diameter from the smaller straight leg style (in the range of 13–16" circumference) to the larger bell type style (23–28") or the intermediate size flared style (16–23"). A commercially successful production machine for sewing hems should be capable of accommdating these various styles. Similarly, a successful machine should be easy to load by the operator. The machine should also be able to apply the necessary tension to the fabric so that proper stitching may be accomplished in a smooth even fashion.

Also, when forming the fold in the hem with automatic folding mechanisms, it is important that the stitching sequence be interrupted or disengaged until the folded material moves into the stitching area. This is necessary because the folding mechanism must be spaced upstream a certain distance in the direction of fabric travel toward the needle.

There is presently available a number of automatic hemming devices, some of which are covered by a number of issued U.S. Patents. Some of these automatic hemming devices are disclosed in the following U.S. Pat. Nos.: 3,783,805 (Guichard); 3,865,058 (Rovin, et al); 4,098,201 (Adamski, Jr., et al); 4,098,204 (Kojima). Other devices which are somewhat related to automatic hemming devices or means for automatically feeding a folded garment to a sewing station include the following patents: U.S. Pat. Nos. 4,191,117 (Della Torre); 4,046,087 (Manetti); 4,185,570 (Klein-schmidt, et al); 3,736,895 (Farrar, et al); 4,037,547 (Marforio); 4,303,027 (Uemura, et al); 4,147,120 (Adamski, Jr., et al); 4,182,251 ( Bloch, et al); 4,241,681 (Porter); and 4,196,681 (Chietti).

Despite the fact that a number of the above disclosed devices have a means for automatically or semi-automatically forming and sewing the hems in garments, including certain tubular-shaped garments, none of the devices discloses a means for selectively varying the size of the device on which the garment to be hemmed is mounted and tensioned in order that various sizes and shapes of garments may be automatically folded or hemmed with the same apparatus in much the same manner as is disclosed by the present invention.

DISCLOSURE OF THE INVENTION

In view of the above short-comings of all known prior art hemming devices, it is apparent that there is a long felt need in the art for an improved automatic hemming device which can be accordingly adjusted to accommodate the different sizes and shapes of tubular-shaped garments. A number of the prior art devices lack ease in loading the tubular garments onto the hemming device and do subsequently result in the final hem being of poor quality, often times with ropiness in the cuff or hem region of the garment. Accordingly, we have invented an apparatus which automatically forms and hems a tubular-shaped garment, once the garment has been manually placed on the apparatus by the operator after the operator has pre-folded a single fold in the garment. Such apparatus comprises an expandable roller and cam assembly which is used to mount and tension the tubular garment about the assembly and to load the garment onto a folding device where the garment is then rotated through a pre-determined distance to form a double hem fold from the single fold hem in the garment prior to the garment being sewn. The apparatus of our invention has the added advantage of being able to accommodate all different types, sizes and shapes of tubular garments and to form hems in the garment of various depths. Our apparatus makes loading of garments onto the machine for hemming much easier than all known prior art devices, and the apparatus results in an excellent quality of hemming by eliminating ropiness in the cuffs of these tubular-shaped garments. The apparatus is further provided with the means for matching up the starting and finishing stitches in the hem of the garment and provides a savings in the hemming operations of garments by eliminating the time required to train operators since the skill required to operate the apparatus is minimal.

It is therefore an object of this invention to provide for a method and apparatus for hemming circular-type garments where the apparatus can be easily and automatically adjusted to accommodate the various sizes and shapes of these circular garments.

It is a further object of this invention to provide for an apparatus which can automatically vary the amount of stitching in a hem from garment to garment.

In addition to the above objects, characteristics, features and advantages of our invention, further benefits and advantages of our invention will be readily appreciated when our invention is considered in connection with the subsequently described figures and the description of the best mode for carrying out our invention.

BRIEF DESCRIPTION OF THE DRAWINGS

FIG. 12 illustrates the double fold made by the folding mechanism, the distance the fabric moves between the folder and the stitcher being shown by the arrow.

FIG. 13 illustrates the drive train when the hem is initially made wherein the sewing machine drive is inoperative such that the fabric may move through the folder toward the needle without being stitched. FIG. 14 illustrates the drive train after the double folded fabric has arrived at the needle wherein the sewing machine drive is reactivated to make the stitch.

BEST MODE FOR CARRYING OUT THE INVENTION

Figures 1, 2A, 2B, 2C:
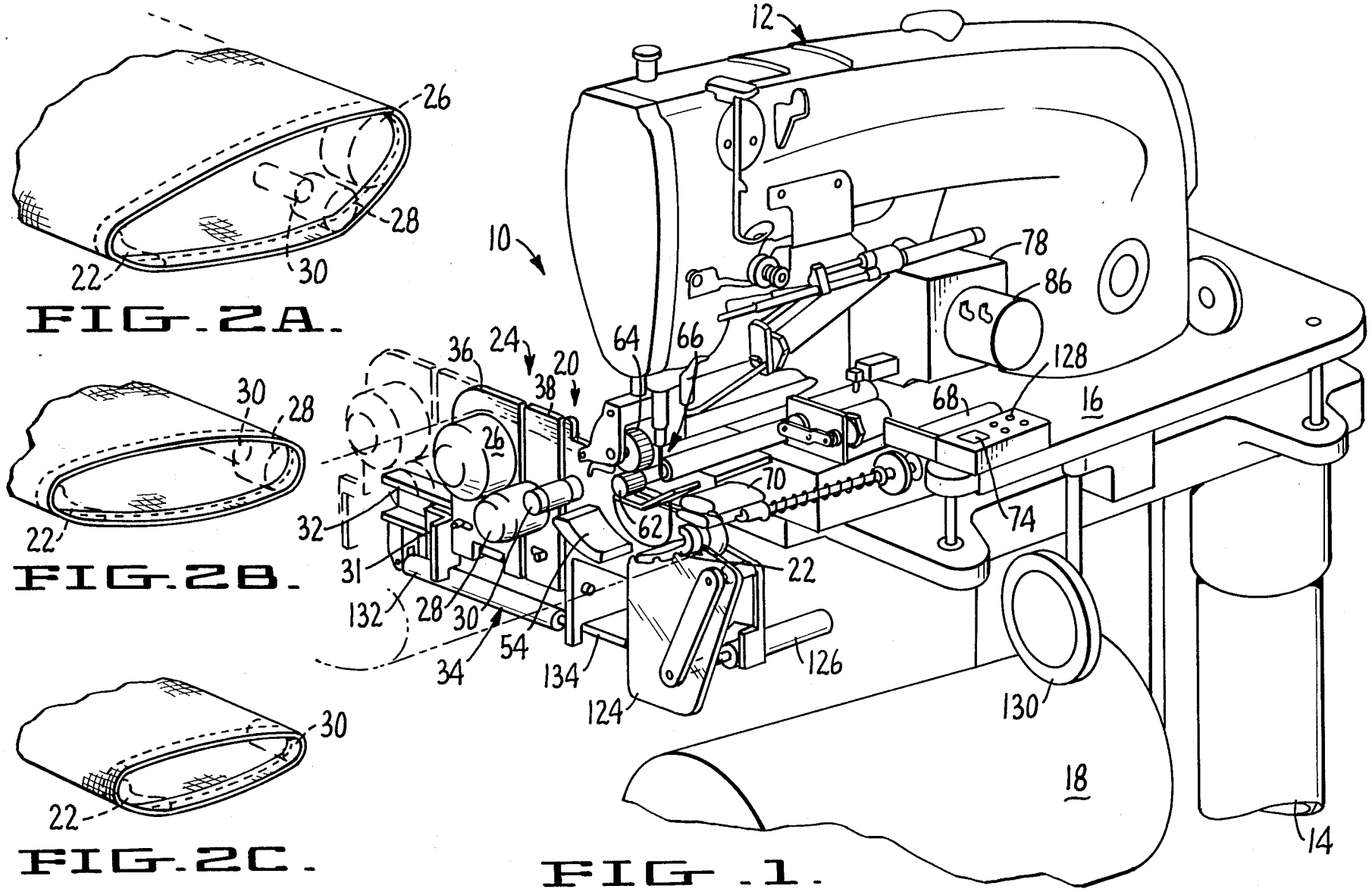
FIG. 1 is a perspective view of the device as viewed from the operator station with the hem expanding assembly shown in solid line ready to receive a garment to be hemmed and shown in phantom line where the garment hem is tensioned and ready for sewing.
FIGS. 2A, 2B and 2C are diagrammatic views of different diameter sizes of hems illustrating how the various expanding rollers are selected to accommodate different size garment legs and to create a minimum free span of fabric between control points.

Now turning to the drawings and in particular FIG. 1, there is shown an automatic hemming device 10 including a standard sewing machine 12 mounted on a pedestal 14 and including a platform 16 and drive motor 18 which may be vertically adjusted on a pedestal 14 to accommodate various operators. The operator would normally sit in front of the device and load the semifinished pants onto the device with the leg in a horizontal position and the leg bottom confronting and overlying mandrel 20. Each leg is hemmed independently of the other. Before placing the leg on the device the operator also forms a first fold in the hem by tucking the raw edge into the leg for a distance of about ⅞" (this distance may vary depending on the desired end result). This makes the initial fold in the fabric with device 10 making the second fold such that the finished hem is approximately ½" or some other predetermined amount and sewn ⅜" from the bottom. Device 10 has a folder or foldling mechanism for making the second fold or tuck in the leg of fabric. It must be understood that the distances and hem sizes specified herein are for illustration only and they may vary from application to application.

Figure 3:
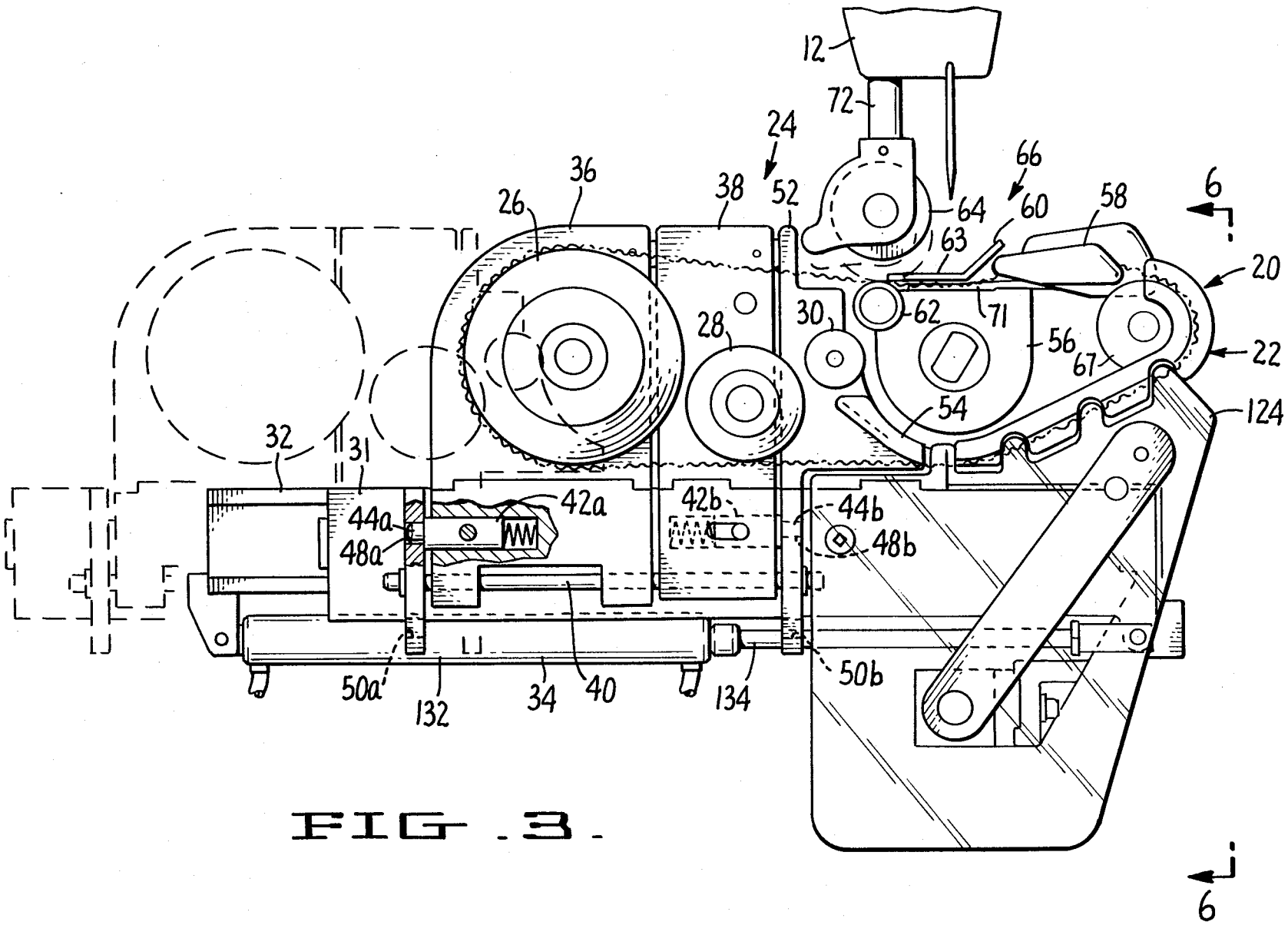
FIG. 3 is a front elevational view of the device of FIG. 1 illustrating the path of the garment hem in the loading position and also illustrating in phantom the maximum movement of the expanding roller assembly.

Mandrel 20 (see FIG. 3) is formed of several fabric guiding parts including a fixed curvilinear guide 22 at the right hand side of FIG. 3 and a movable expanding roller assembly 24 spaced to the left from part 22. Assembly 24 is formed of three independent rollers, i.e., a large roller 26 at the left of FIG. 3 used for bell leg style hems, a medium roller 28 used for flared leg style hems and a small roller 30 for use on straight leg style hems.

Assembly 24 includes carriage 31 mounted on ball slide 32 and movable thereon by piston cylinder 34 toward the phantom line position as viewed at the left of FIG. 3. Ball slide 32 is mounted on the front edge of platform 16. Cylinder 34 is air driven by a suitable control and pneumatic system (not shown) to move the roller assembly 24 away from fixed curvilinear guide 22 and to tension the leg bottom positioned there between. The means to move the rollers 26, 28 and 30 could very well be a radius arm or kinematic link providing approximate straight line motion in place of the linear slide disclosed.

Figure 4:
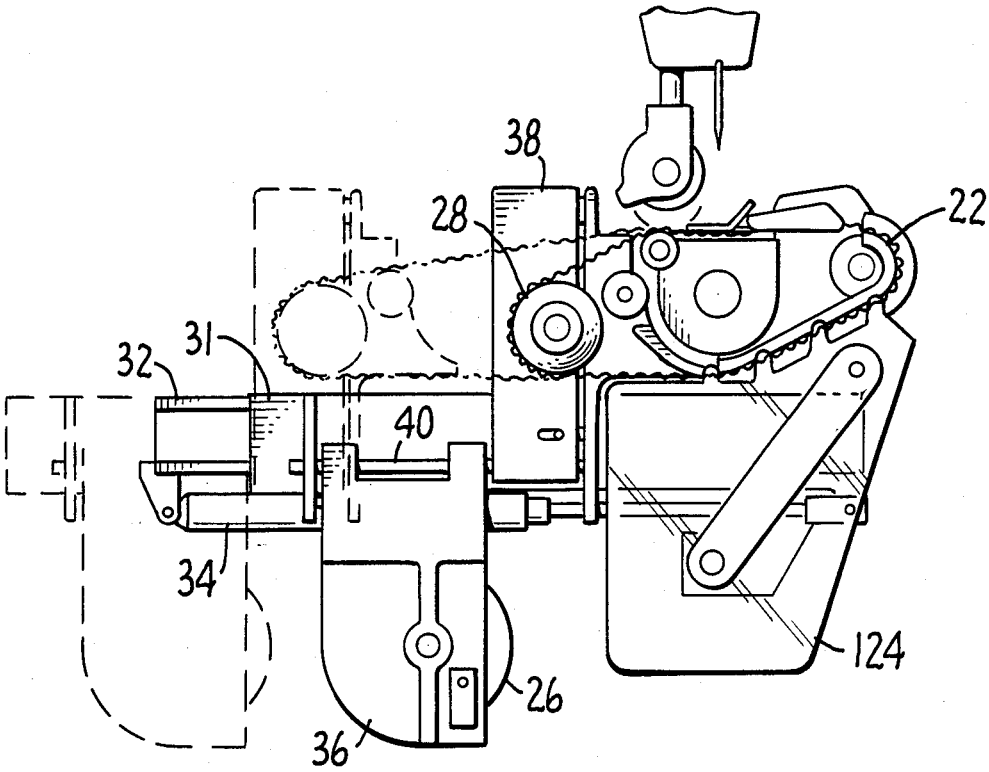
FIG. 4 is a view similar to FIG. 3 illustrating the device when it is used on intermediate size hems.
Figure 5:
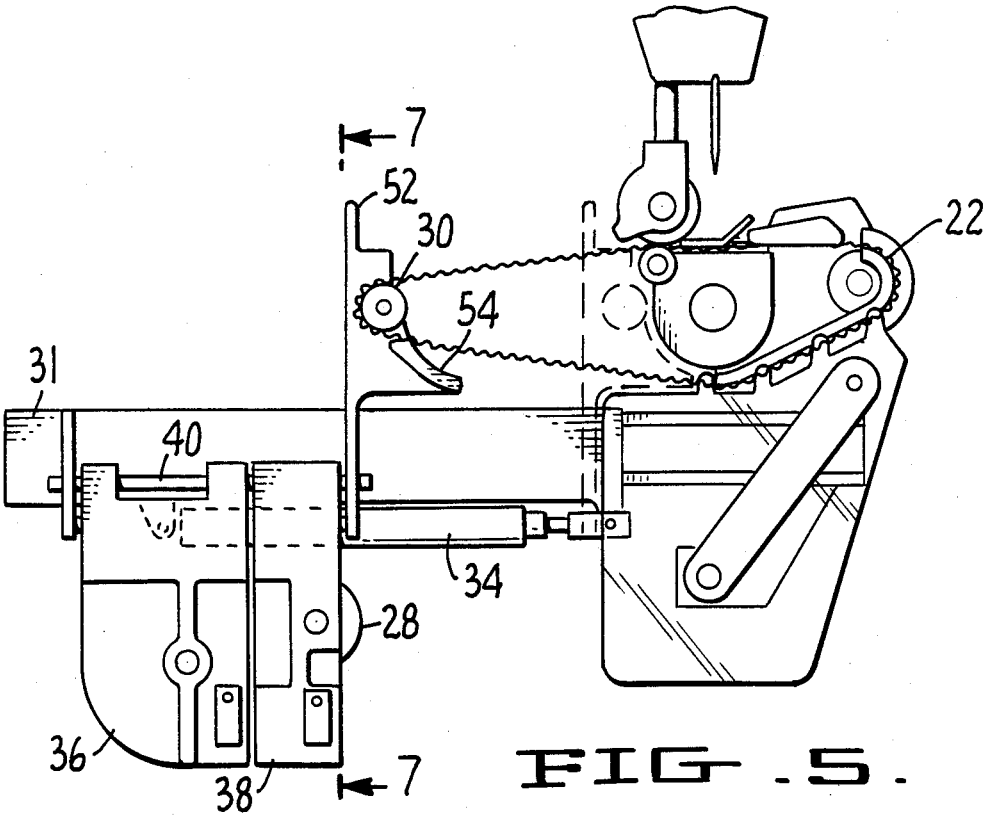
FIG. 5 is a view similar to FIGS. 3 and 4, illustrating the device when it is set up to accommodate the smaller size hems.
Figure 8:
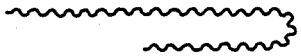
FIG. 8 is a diagrammatic cross-sectional view of a single fold in the hem made by the operator as it is first positioned on the device.
Figure 9:
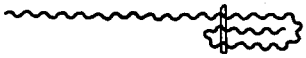
FIG. 9 is a diagrammatic cross-sectional view of the hem after it has been double folded and stitched by the device to form the desired hem.
Figure 6:
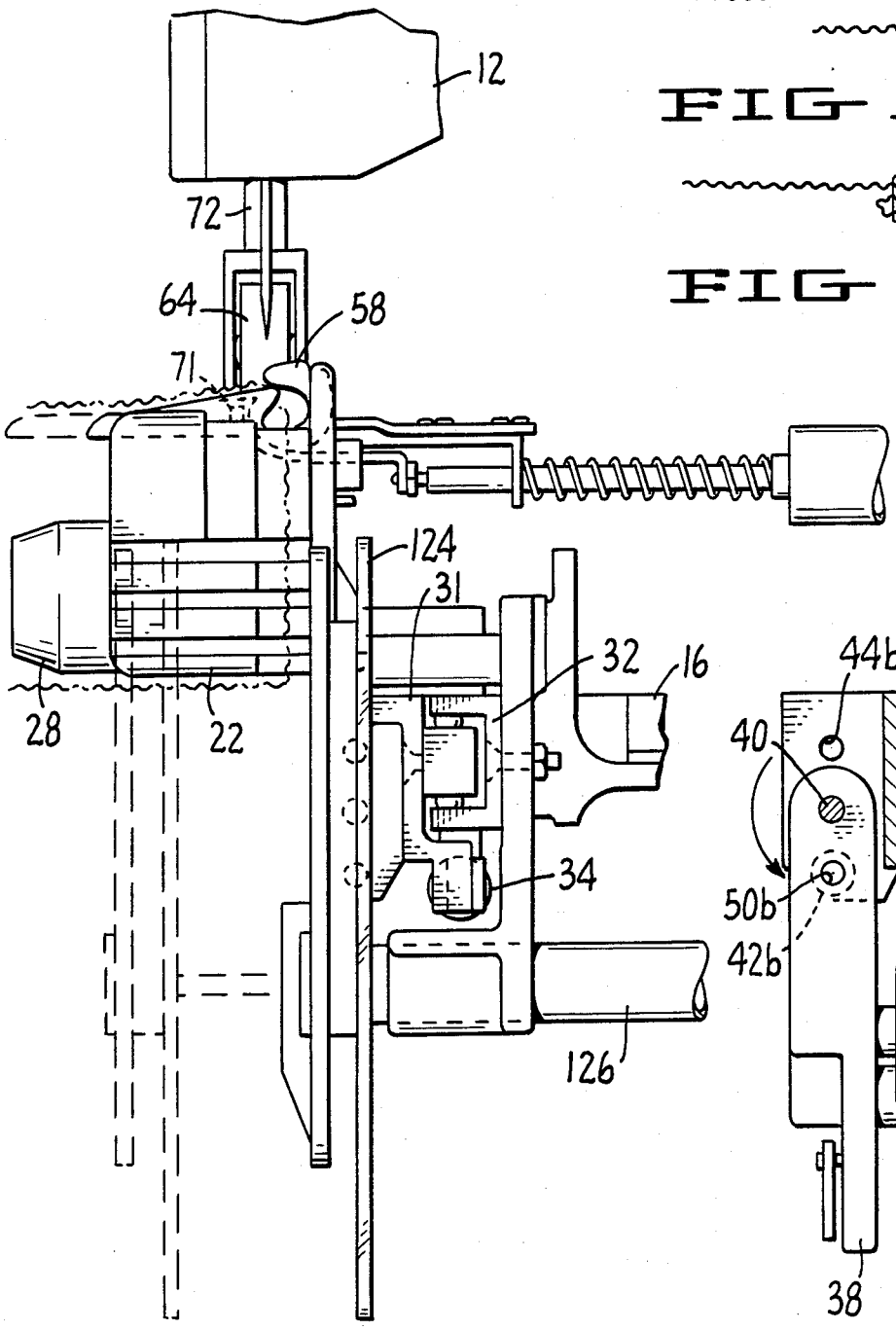
FIG. 6 is an end elevational view of the device of FIG. 3 taken looking from the right hand thereof along line 6—6 and illustrating in phantom line the position of the garment edge in relation to the folder mechanism, sewing head and tensioning means.
Figure 7:
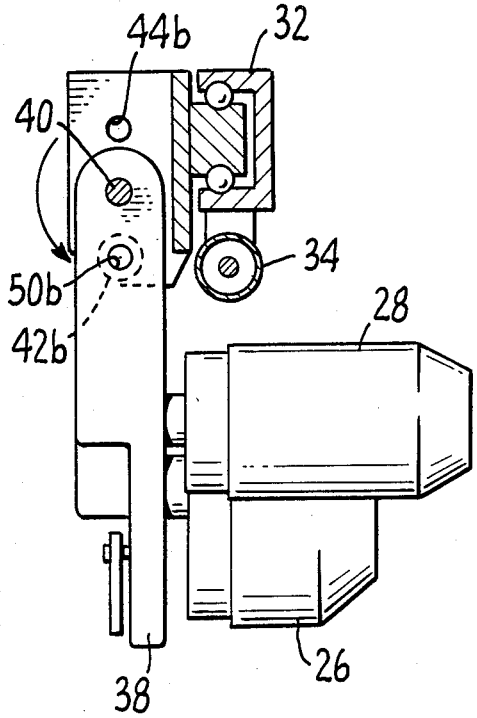
FIG. 7 is a sectional view taken along line 7—7 of FIG. 5 and illustrating the slide mechanism and the expanding roller assembly in its alternate position.
Figure 10:
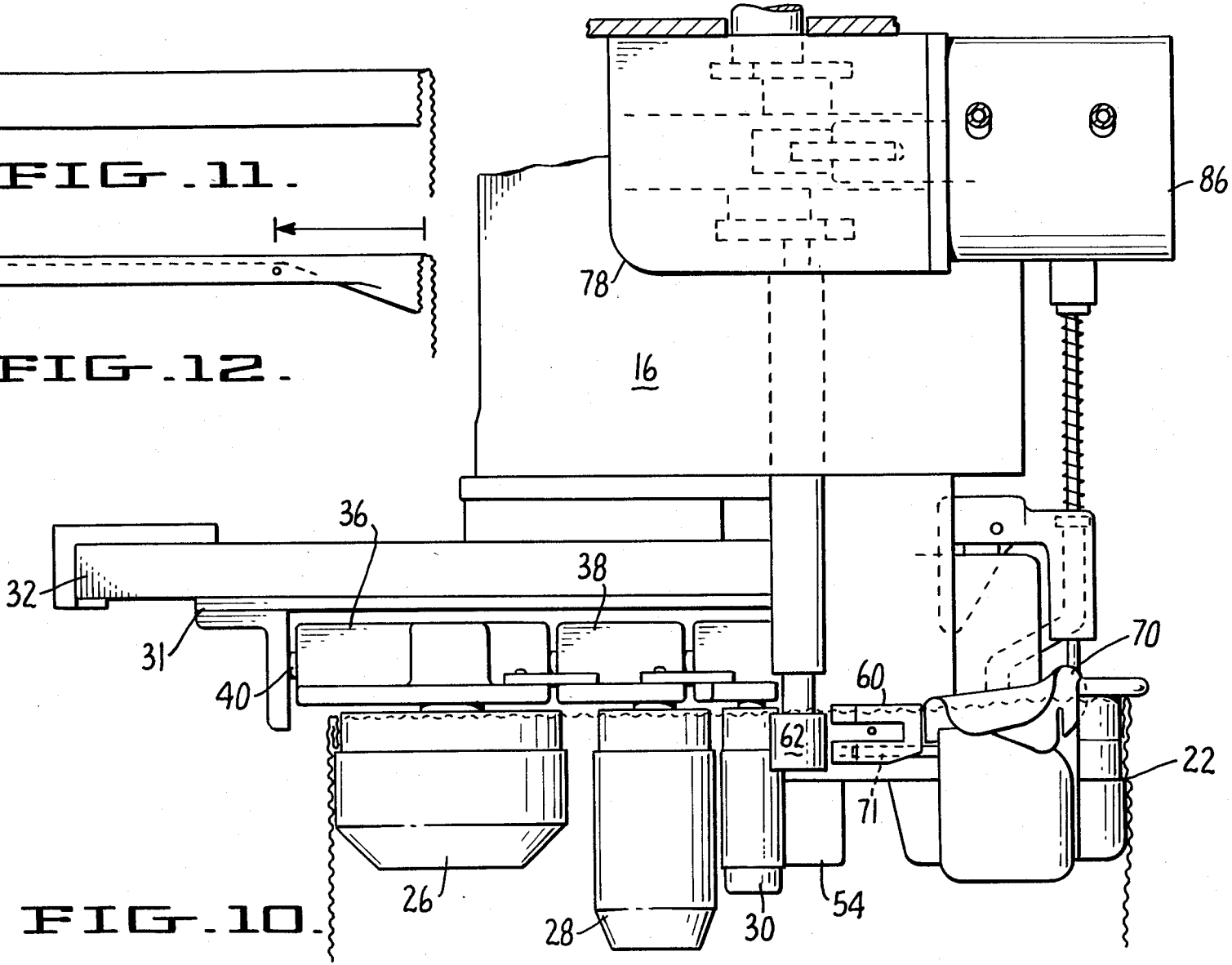
FIG. 10 is a top plan view of the device of FIG. 3 illustrating the path of the hem (shown in phantom line) and moving from right to left over the fixed guide, folding mechanism, presser foot and sewing needle, sewing machine feed rollers and associated indexing unit and over the expanding roller assembly.
Figure 11:
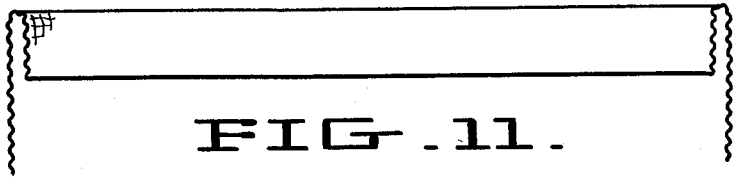
FIGS. 11 and 12 are diagrammatic cross-sectional views, similar to FIGS. 8 and 9, and illustrating, in FIG. 11, the single fold in the garmet when initially placed on the device.
Figure 12:
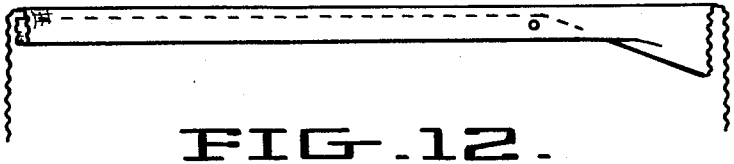

As will be appreciated large roller 26 and medium roller 28 are independently mounted on carriage 31 by hinged carriers 36 and 38, respectively, through pivot rod 40. Each carrier includes a latch 42*a*, 42*b* having a pin 44*a*, 44*b* locking the carrier in an upright position when placed in hole 48*a* and 48*b* of carriage 31 or swingable to a downward, out of the way position when pin 42*a*, 42*b* is in hole 50*a*, 50*b*. Either or both carriers may be swung out of the way as shown in FIGS. 4 and 5. Carriage 31 is pivoted so that at various times the rollers of the expandable roller assembly 24 may move down and out of the way depending on the circumference of the garment to be hemmed.

Small roller 30 is rotably carried on upstanding strut 52 of carriage 31, while curvilinear guide 54 is carried near the lower end of strut 52. Both guide 22 and guide 54 extend outward into the plane of rollers 26, 28 and 30 and serve to support and guide the fabric around bobbin 56. Guide 22 also acts as the stationary part of mandrel 20 and directs the faric into folding mechanism 58, presser foot 60 and into the sewing machine feeder roll 62 and pinch roll 64 in stitching area 66. Guide 22 could also include a roller 67 as shown in FIG. 3.

Folding mechanism 58 is a well known device and is movable by piston cylinder 68 to move end 70 against the preformed single fold and tuck the raw edge under for a second fold prior to stitching. Upstanding rail 71 on the throat plate guides the folded hem into the stitching area.

Pinch roll 64 is vertically movable on slide rod 72 by a suitable piston (not shown) and allows the nip 63 between rolls 62 and 64 to open when the operator is loading the device (Part of Sewing Machine.)

Figure 13:
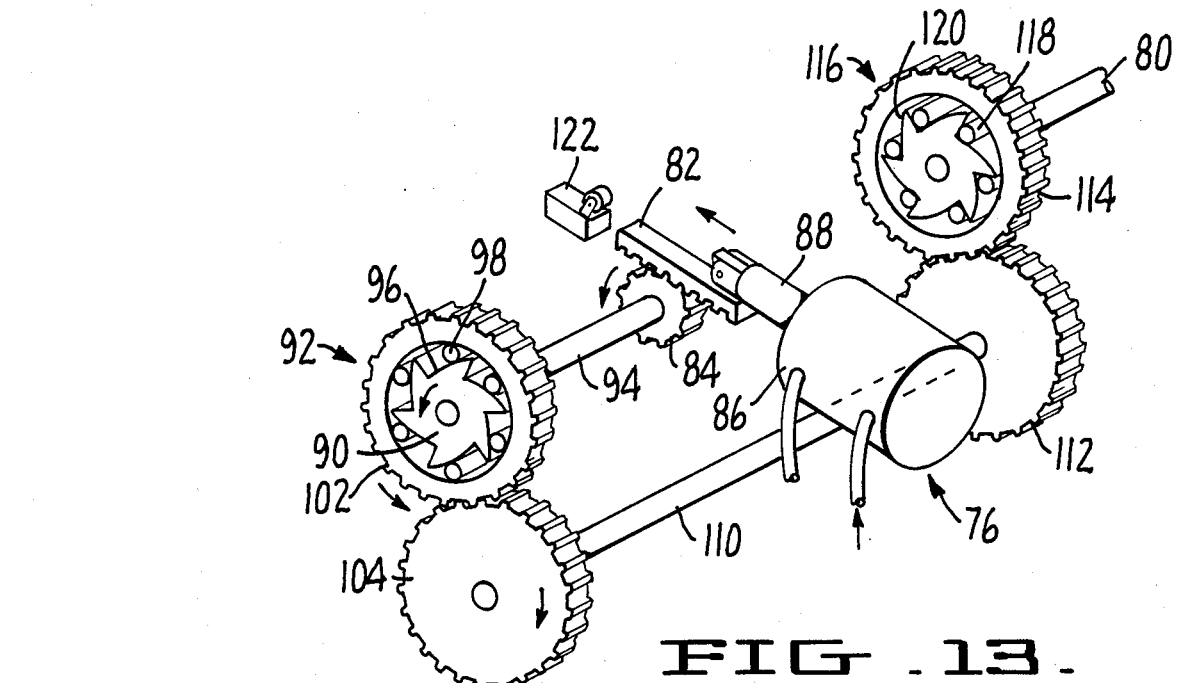
FIGS. 13 and 14 are diagrammatic perspective views of the sewing machine feed rollers and indexing unit.
Figure 14:
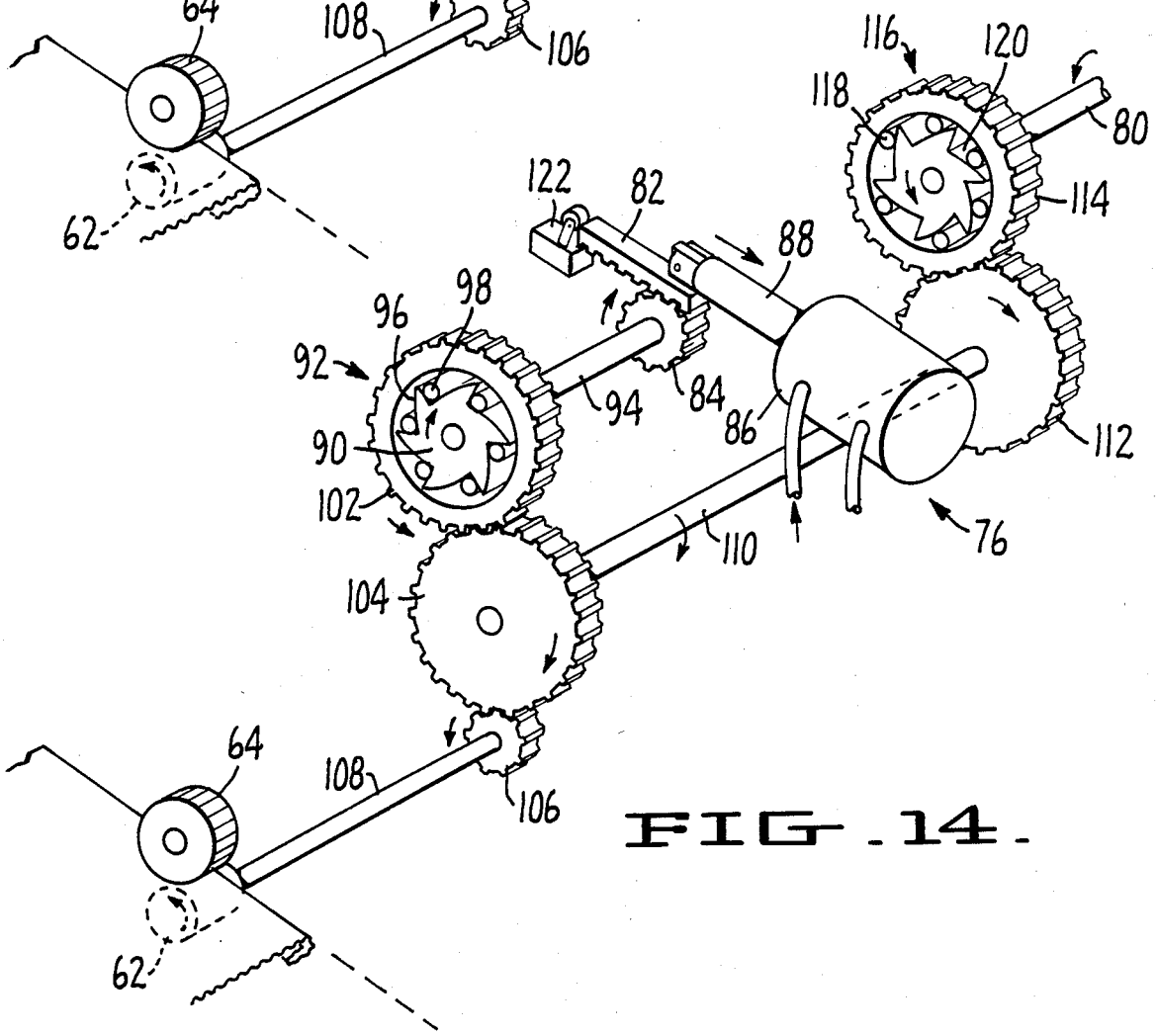

Feeder roll 62 is driven in synchronization with the sewing mechanism by sewing machine motor 18. The operator preselects the number of stitches depending on the diameter of the hem plus the overlapping staystitch. The total number of stitches is controlled by stitch counter 74. Prior to stitching, however, feeder roll 62 must initially move the untucked material through the folding mechanism and into the stitching area. This is accomplished by providing secondary drive means 76 in indexer 78 which will drive roller 62 an amount to move the double folded hem into the stitching area and then start the sewing machine motor which drives roller 62 through the sewing machine mechanism while the secondary drive means resets. Looking to FIGS. 13 and 14 there is shown in FIG. 13 roller 62 driven by secondary drive means 76 while sewing machine output shaft 80 is inoperative. Rack 82 rotates pinion 84 when cylinder 86 moves piston rod 88 outward. Pinion 84 drives the inner element 90 of one way or overriding clutch 92 through shaft 94 Wedge faces 96 on inner element 90 press clutch elements 98 outward into contact with ring gear 102. Rack 82, pinion 84, one way clutch 92, gear 104, and gear 106 form a drive train to rotate feed roller 62 through shaft 108. Shaft 110 on gear 104 also rotates gear 112 and ring gear 114 of one way clutch 116, but as shown, clutch elements 118 ride down wedge surfaces 120 and do not transmit power back through shaft 80 to the sewing machine mechanism. At the completion of the piston stroke, rack 82 trips sensor switch 122 and starts the sewing sequence.

During the sewing sequence shaft 80 rotates gear 112 through now engaged clutch 116 and shaft 110 rotates gear 104 and gear 106 to continue to rotate feed roller 62. Piston rod 88 reverses direction, drawing rack 92 across pinion 84, but this motion is not transmitted back through one way clutch 92 because elements 98 are now on the inner side of wedge faces 96. Obviously, other one way or overriding clutches could be used.

After the sewing sequence is completed, tension is removed from the leg when carriage 31 moves inward and pusher plate 124 is driven outward by cylinder 126 to strip the finished hem from the mandrel.

In operation, the proper roller configuration is selected either for a large tube as shown in FIGS. 2A and 3; a medium tube as shown in FIGS. 2B and 4 or a small tube as shown in FIGS. 2C and 5. The proper stitch count is selected on terminal 128. The operator manually puts a first fold in the leg end and places the leg over the mandrel and actuates the sequence by pressing on a foot or hand switch not shown. Cylinder 132 expands outward from piston rod 134 to move carriage 31 away from fixed guide 22. This stroke varies depending on the diameter of the leg and the tension imparted thereto may be adjusted by regulating the air pressure in cylinder 132.

Pinch roller 64 next moves downward to grip the material against feed roller 62. Folding mechanism 58 tucks the raw edge of the leg bottom into a second fold while the material is rotated around the mandrel by secondary drive means 76 in a counterclockwise direction as viewed in FIGS. 3–5. When sensor switch 122 is tripped, indicating that the second folded material has arrived at the stitching area, sewing machine motor 18 now advances the material through feed roll 62 while stitching the hem for the aforesaid designated number of stitches. Folder mechanism is retracted after the leg has made one revolution. When the stitching is completed pinch roller 64 is raised, carriage 31 is retracted to remove the tension on the garment and pusher 124 is actuated to dispense the finished leg from mandrel 20.

It is to be understood that this invention has been described and the application has made reference to certain specific dimensions (i.e., hem sizes, leg circumference, etc.) for purposes of illustration only. The sizes, shapes, dimensions, number of rollers in the expandable roller assembly, etc. may all be varied and still come within the scope, intent and equivalence of our invention. Our invention is limited only by the appended claims.

We claim:

1. An apparatus for automatically hemming tubular-shaped garments under a sewing head of a sewing machine comprising:

a folder device, including a first drive mechanism operatively connected to a set of drive rollers, for rotating the hem region of a garment;

an expandable roller assembly and guide means operatively connected to said folder device, for mounting said garment and for subsequently loading the hem region of said garment into an opening of said folder device;

means for tensioning said garment about said roller and guide means prior to closing said folder device about said garment;

means for energizing said drive rollers by the first drive mechanism to engage said garment within said folder device to rotate said garment through a predetermined distance and to advance said garment in a direction opposite the opening in said folder device to form a fold in the hem region of the garment;

a sensing device opeatively connected to the first drive mechanism and to said sewing head of said sewing machine to determine a sewing garment has been rotated in the folder device through a predetermined distance and to thereafter disengage the first drive mechanism; and said sensing device is further operatively connected to a second drive mechanism such that when the first drive mechanism is disengaged, the second drive mechanism is engaged to again energize said drive rollers to engage said garment and advance the now folded hem region of said garment into a stitching area of said sewing machine for sewing the hem of the garment.

2. The apparatus of claim 1 wherein the expandable roller assembly comprises a number of independently mounted rollers which are selectively made a part of said roller assembly to accomodate the different circumferences of tubular garments to be mounted and tensioned thereon.

3. The apparatus of claim 1 wherein the number of stitches required to form the hem in the garment is predetermined by the circumference of the tubular garment to be hemmed and is preset by a stitch counter prior to the second drive mechanism energizing the drive rollers to engage the garment and advance the hem region of said garment into the stitching area of said sewing machine.

4. A method of forming a double hem in a tubular garment comprising the following steps:

manually folding the garment through a single fold about the hem region by a predetermined amount to conceal the raw edges of the garment;

loading the garment onto an expandable roller assembly and guide means while inserting the single-folded hem region of said garment into the opening of a folder device;

tensioning the garment about said expandable roller assembly and guide means;

closing said folding device about said garment and energizing drive rollers to rotate and advance the single-folded hem in the direction perpendicular to the opening of the folder device through a predetermined distance to form a second fold in the hem region of the garment;

sensing the distance traversed by said garment in said folder device such that said garment hem region complets a double fold; and advancing the now double-folded hem under the sewing head of a machine to be sewn.

* * * * *